US007693472B2

(12) United States Patent
Hiramoto et al.

(10) Patent No.: US 7,693,472 B2
(45) Date of Patent: Apr. 6, 2010

(54) IMAGE FORMING APPARATUS WITH PRESSING ROLLER

(75) Inventors: Yoshiaki Hiramoto, Yamatokoriyama (JP); Seiichi Kizu, Ikoma (JP); Masatsugu Hatanaka, Kashiwara (JP); Motokazu Nakao, Sakurai (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 588 days.

(21) Appl. No.: 11/651,097

(22) Filed: Jan. 9, 2007

(65) Prior Publication Data

US 2007/0172271 A1 Jul. 26, 2007

(30) Foreign Application Priority Data

Jan. 24, 2006 (JP) ..... 2006-014819

(51) Int. Cl.
*G03G 15/20* (2006.01)

(52) U.S. Cl. ..... 399/328; 399/333

(58) Field of Classification Search ..... 399/328, 399/331, 333

See application file for complete search history.

(56) References Cited

U.S. PATENT DOCUMENTS 7,251,447 B2 * 7/2007 Kanamori et al. ..... 399/333

FOREIGN PATENT DOCUMENTS

| | | | |
|---|---|---|---|
| JP | 7-160139 | A | 6/1995 |
| JP | 8-16030 | A | 1/1996 |
| JP | 8-123230 | A | 5/1996 |
| JP | 09-152803 | | 6/1997 |
| JP | 9-152803 | A | 6/1997 |
| JP | 2002-31983 | A | 1/2002 |
| JP | 2004-144224 | | 10/2002 |
| JP | 2004-144224 | | 5/2004 |

* cited by examiner

*Primary Examiner*—William J Royer
(74) *Attorney, Agent, or Firm*—Birch, Stewart, Kolasch & Birch, LLP

(57) ABSTRACT

An image forming apparatus includes: a paper conveying portion for conveying a paper; an image forming portion for forming a visible toner image on the paper being conveyed, with a toner in accordance with input image information; and a fixing unit for fusing and fixing an unfixed toner image formed on the paper to the paper by using a heat roller and a pressing roller, and is constructed such that the pressing roller is composed of a metal core that forms a core shaft of the pressing roller and an elastic part that covers an outer periphery of the metal core, and a heat capacity at a center portion of the pressing roller with respect to a direction perpendicular to a paper's direction of conveyance is smaller than heat capacities at both ends of the pressing roller.

8 Claims, 11 Drawing Sheets

IMAGE FORMING APPARATUS WITH PRESSING ROLLER

This Nonprovisional application claims priority under 35 U.S.C. §119(a) on Patent Application No. 2006-14819 filed in Japan on 24 Jan. 2006, the entire contents of which are hereby incorporated by reference.

BACKGROUND OF THE INVENTION (1) Field of the Invention

The present invention relates to an image forming apparatus, in particular relating to an image forming apparatus in which electro-photographically forms printouts by visualizing image information with a developer and fixing the image information on recording medium by fixing rollers.

(2) Description of the Prior Art

Conventionally, an image forming apparatus such as a copier, printer or the like achieves an image forming process by the steps of: developing an electrostatic latent image of an original image written on a photoreceptor drum, with a developer supplied from a developing unit; transferring the developer image (toner image) onto a recording medium such as recording paper fed from a paper feed cassette; fusing and fixing the toner image transferred on the recording paper by means of a fixing unit made up of a heat roller and a pressing roller, for example, and finally outputting the printed paper.

Generally, the fixing unit used for an image forming apparatus includes, as its essential components, a heat roller, a pressing roller and a heat source for heating the heat roller. With the thus configured fixing unit, a recording sheet with a toner image of unfixed toner formed thereon is led to the contact nip between the heat roller and pressing roller, so that the toner image on the recording paper receives heat from the heat roller surface as it is being passed through the contact nip and the developer is fused and fixed to the recording paper by the pressing force from the paired rollers.

In recent years, in the field of image forming apparatuses, high-speed type machines capable of printing out 80 sheets per minute or greater have been under development. The fixing unit for fixing toner images to recording paper in an image forming apparatus absolutely needs to fuse and fix toner images (image information) onto the recording paper being conveyed, however there is a limit to the condition of installation under which the image forming apparatus is installed. That is, in general, since the specification of the usual power supply is 100 V, 15 A, the maximum power consumption is limited under 1500 W, in the existing circumstance. Accordingly, it is impossible in the status quo to expect drastic enhancement of the power to support high-speed configurations.

To deal with this situation, in order to efficiently use the power for fixing, there has been a generally known configuration in which a main heater (the heater for small-sized paper) and a sub heat (the heater used in combination with the main heater to deal with large-sized paper) are provided inside the heat roller so as to efficiently heat the heat roller.

Also, there is a known conventional configuration in which a heat roller is formed of a thick-wall roller capable of accumulating a predetermined amount of heat or a thin-wall roller capable of quickly transferring heat from a heat source to the roller surface while a pressing roller is formed of a metal core and an elastic material (typically, made of rubber) covered thereon to enhance the sticking effect of fused toner to the recording paper being conveyed, to thereby apply a predetermined pressure onto the heat roller (Patent document 1: Japanese Patent Application Laid-open 2004-144224).

Now, one configurational example of a conventional fixing portion will be described with reference to the drawings.

FIG. 1 is a schematic side view showing a configuration of a heat roller and a pressing roller which constitutes a fixing unit mounted in a conventional image forming apparatus, and FIG. 2 is a schematic sectional view showing the structure of the heat roller and pressing roller.

A fixing unit 130 mounted in an image forming apparatus includes a heat roller 131 and a pressing roller 132, as shown in FIGS. 1 and 2, and is adapted to fuse and fix a toner image that has been transferred on paper P in an unillustrated image forming portion, by rotating heat roller 131 with the recording paper (to be referred to as paper, hereinbelow) P held between heat roller 131 and pressing roller 132 so as to allow the paper to pass between heat roller 131 and pressing roller 132.

In the above way, heat roller 131 and pressing roller 132 which constitute the fixing rollers are arranged so as to hold paper P therebetween with a predetermined pressure when the paper P passes through the nip.

Arranged on the outer periphery of heat roller 131 are a non-contact type thermistor 135*a* for detecting the surface temperature around the center of the outer peripheral surface and a contact type thermistor 135*b* for detecting the surface temperature near the roller end.

Heat roller 131 is composed of a hollow cylindrical metal core 131*a* and an elastic part 131*b* of a material having heat resistance such as silicone rubber which covers the outer peripheral side of metal core 131*a* with a predetermined thickness. A main heater 133 and a sub-heater 134 are arranged in the interior space of metal core 131*a* in the extended direction of heat roller 131's axis (there will be some cases in which this direction is referred to as "axial direction", hereinbelow).

Main heater 133 has a heater element 133*a* around the center, designated at 131*c*, in the axial direction of heat roller 131 so as to heat the center 131*c* and thereabout of heat roller 131.

On the other hand, sub heater 134 includes a pair of heater elements 134*b* and 134*c* extended from respective ends 133*b* and 133*c* of heater element 133*a* of main heater 133 to both ends 131*d* and 131*e* along the axial direction of heat roller 131 so as to heat both ends 131*d* and 131*e* of heat roller 131 where the heat roller 131 opposes the side edge portions of large-sized paper.

Main heater 133 is mainly used to fix small-sized paper, and sub heater 134 is used in combination with main heater 133 to fix large sized paper.

The thus constructed main heater 133 and sub heater 134 are controlled by an unillustrated heater temperature controller so as to keep the surface temperature of heat roller 131 at the predetermined temperature in conformity with the paper size when the developer image is fixed to the paper.

Pressing roller 132 is composed of a solid cylindrical metal core 132*a* and an elastic part 132*b* of a material having heat resistance such as silicone rubber which covers the outer peripheral side of metal core 132*a*, forming a cylindrical structure having an essentially uniform outside diameter. The pressing roller 132 is arranged in parallel with, along the axial direction of, and abutted against, heat roller 131.

Here, one example of temperature control of heat roller 131 will be shown.

FIG. 3 is an illustrative view showing the temperature distributions on the surfaces of a heat roller and a pressing roller in an image forming apparatus in its operation ready mode; FIG. 4 is an illustrative view showing heat supply distributions of heaters of the heat roller; FIG. 5 is an illustrative view showing the temperature distributions on the surfaces of the heat roller and the pressing roller when small-sized paper is fixed by the fixing unit; and FIG. 6 is an illustrative view showing the temperature distributions on the surfaces of the heat roller and the pressing roller when large-sized paper is fixed by the fixing unit.

When the image forming apparatus is ready for operation, main heater 133 and sub heater 134 are controlled so that the surface temperature of heat roller 131 is maintained at approximately 200 deg. C. uniformly along the axial direction, as shown in FIG. 3 while the surface temperature of pressing roller 132 is kept at approximately 120 to 130 deg. C. along the axial direction.

As shown in FIG. 4, sub heater 134 is adapted to have such a heat supply distribution that more heat is generated at both ends of heat roller 131 (areas A2 indicated by the broken line in the drawing), taking into account heat radiation from the roller ends.

Usually, the surface temperature of the heat roller in the image forming apparatus is controlled so as to be set at approximately 180 to 200 deg. C. (designated fixing temperature) as the necessary temperature set for fixing, whereas the surface temperature of the pressing roller is not controlled, and generally falls within the range of approximately 120 to 150 deg. C., as a result of heat transfer via the press contact (fixing nip) between the heat roller and pressing roller.

In the above configuration, when a print request is made to the image forming apparatus, the surface temperatures of heat roller 131 and pressing roller 132 lower in the area where the paper passes through as shown in FIGS. 5 and 6, because heat is taken from the rollers by the passage of paper and by being used for fusing and fixing unfixed toner.

When the surface temperature of heat roller 131 has become lower than the designated fixing temperature, temperature control is performed so as to effect a stable fixing process. As shown in FIGS. 5 and 6, the part where the temperature lowers corresponds to the area, on each roller, which the paper passing through the nip comes into contact with (passage paper contact area).

However, since no reduction in temperature takes place in the passage paper non-contact areas of each roller, if a temperature raising control is performed in order to compensate for the temperature reduction in the passage paper contact part, the temperatures of heat roller 131 and pressing roller 132 are raised excessively, particularly, in the passage paper non-contact areas, causing the problem that the temperature at both ends of the rollers becomes higher than the designated fixing temperature.

When continuous feed of paper is done with the fixing unit of this configuration, the temperature of the heat roller is raised in the passage paper non-contact areas, resultantly causing degradation of heat roller 131 and pressing roller 132 in their life characteristics.

SUMMARY OF THE INVENTION

In view of the above conventional problem, it is therefore an object of the present invention to provide an image forming apparatus in which the lives of the heat roller and pressing roller are increased by regulating the temperature rise at the ends of the heat roller during continuous feed of paper through the fixing portion in the image forming apparatus.

In order to solve the above problem, the image forming apparatus according to the present invention is configured as follows.

An image forming apparatus according to the first aspect of the present invention includes: a recording medium conveying portion for conveying a recording medium; an image forming portion for forming a visible developer image on the recording medium being conveyed, with a developer in accordance with input image information; and a fixing portion for fusing and fixing the unfixed developer image formed on the recording medium to the recording medium by means of a heat roller and a pressing roller, and is characterized in that the pressing roller is composed of a metal core that forms the core shaft of the pressing roller and an elastic part that covers the outer periphery of the metal core, and is constructed so that the heat capacity at the center portion of the pressing roller with respect to the direction perpendicular to the recording medium's direction of conveyance is smaller than the heat capacities at both ends of the pressing roller.

An image forming apparatus defined in the second aspect of the present invention is characterized in that, in addition to the configuration described in the first aspect, the elastic part is formed so that the covering thickness at the position which opposes the center of a recording medium with respect to the direction perpendicular to the recording medium's direction of conveyance is thinner than the covering thickness at the positions that oppose the side edges of the recording medium.

An image forming apparatus defined in the third aspect of the present invention is characterized in that, in addition to the configuration described in the first or second aspect, the metal core has an approximately cylindrical external shape and is constructed such that the outside diameter of the metal core at the position opposing the center of recording medium with respect to the direction perpendicular to the recording medium's direction of conveyance is greater than the outside diameter at the positions that opposes the side edges of the recording medium.

An image forming apparatus defined in the fourth aspect of the present invention is characterized in that, in addition to the configuration described in any one of the first through third aspects, the elastic part is formed so that the covering thickness varies along the axial direction of the pressing roller in conformity with the designated surface temperature of the heat roller, so as to make the surface temperature of the heat roller during a continuous fixing process by the fixing unit approximately uniform along the axial direction.

In accordance with the first aspect of the present invention, in the image forming apparatus comprising: a recording medium conveying portion for conveying a recording medium; an image forming portion for forming a visible developer image on the recording medium being conveyed, with a developer in accordance with input image information; and a fixing portion for fusing and fixing the unfixed developer image formed on the recording medium to the recording medium by means of a heat roller and a pressing roller, the pressing roller is composed of a metal core that forms the core shaft of the pressing roller and an elastic part that covers the outer periphery of the metal core, and is constructed so that the heat capacity at the center portion of the pressing roller with respect to the direction perpendicular to the recording medium's direction of conveyance is smaller than the heat capacities at both ends of the pressing roller. This configuration makes it possible to prevent temperature rise at the ends of the heat roller in the fixing portion when continuous feed of paper is done, hence it is possible to increase the lives of the heat roller and the pressing roller.

In accordance with the inventions according to the second to fourth aspects of the present invention, the following effects can be obtained in addition to the above common effect which can be obtained from the first aspect of the invention.

That, in accordance with the second aspect of the present invention, since the elastic part is formed so that the covering thickness at the position which opposes the center of a recording medium with respect to the direction perpendicular to the recording medium's direction of conveyance is thinner than the covering thickness at the positions that oppose the side edges of the recording medium, this configuration, in addition to the effect achieved by the first aspect of the invention, makes it possible to increase the heat storage capacity of the pressing roller owing to the elastic part, at both ends compared to that in the center area, thus it is possible to prevent temperature rise at both ends of the heat roller.

In accordance with the third aspect of the present invention, since the metal core has an approximately cylindrical external shape and is constructed such that the outside diameter of the metal core at the position opposing the center of recording medium with respect to the direction perpendicular to the recording medium's direction conveyance is greater than the outside diameter at the positions that opposes the side edges of the recording medium, this configuration, in addition to the effect achieved by the first or second aspect of the invention, makes it possible to occupy a greater proportion of volume for the elastic part around the end areas of the pressing roller than that around the center portion thereof.

In accordance with the fourth aspect of the present invention, since the elastic part is formed so that the covering thickness varies along the axial direction of the pressing roller in conformity with the designated surface temperature of the heat roller, so as to make the surface temperature of the heat roller during a continuous fixing process by the fixing unit approximately uniform along the axial direction, this configuration, in addition to the effect achieved by the second or third aspect of the invention, makes it possible to reduce the temperature variation between the passage paper contact area and the passage paper the non-areas of the heat roller and pressing roller.

DESCRIPTION OF THE PREFERRED EMBODIMENTS

The embodiment of the present invention will hereinafter be described in detail with reference to the drawings.

Figure 1:
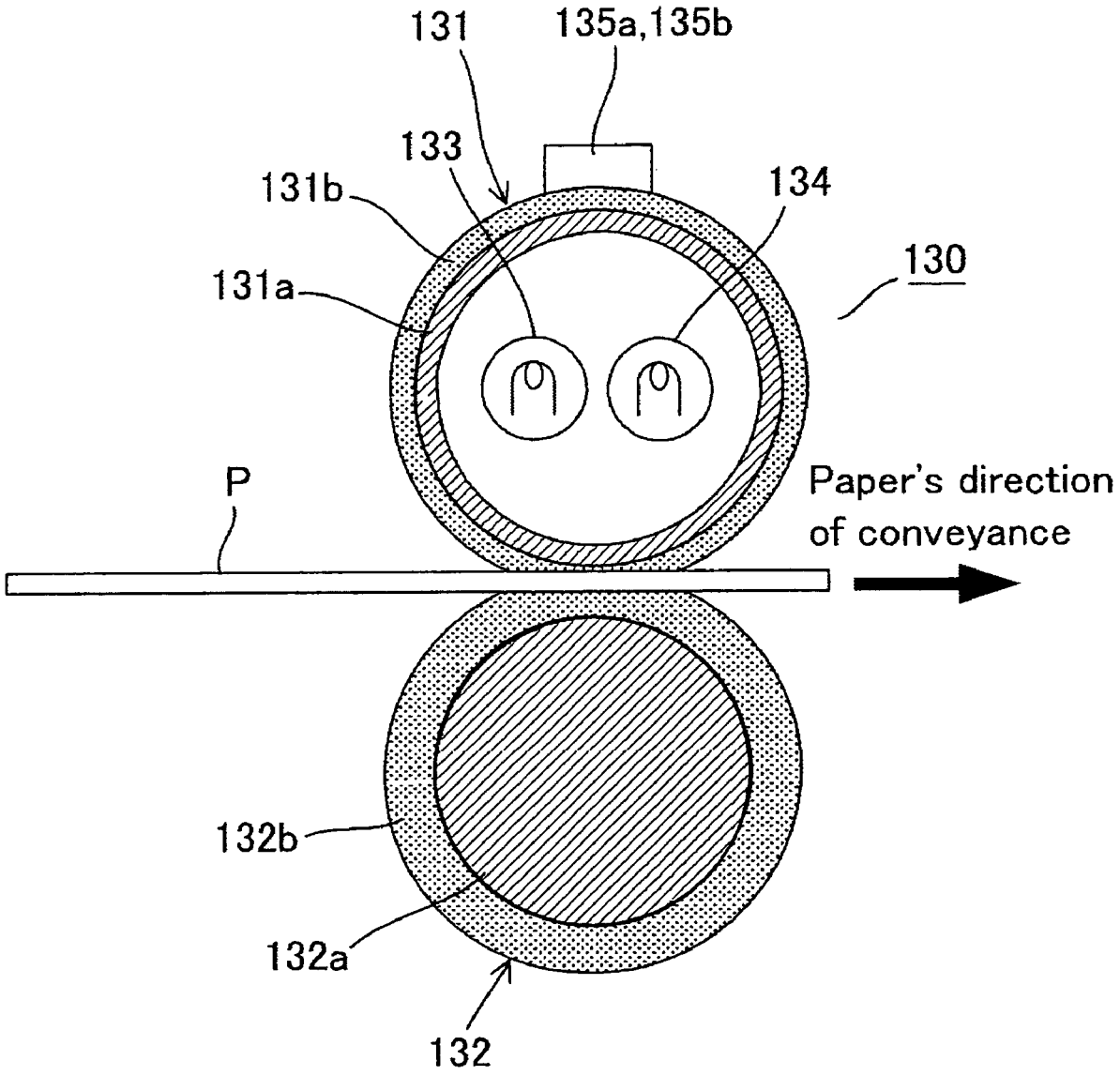
FIG. 1 PRIOR ART
FIG. 1 is a schematic side view showing a configuration of a heat roller and pressing roller which constitute a fixing unit mounted in a conventional image forming apparatus.
Figure 2:
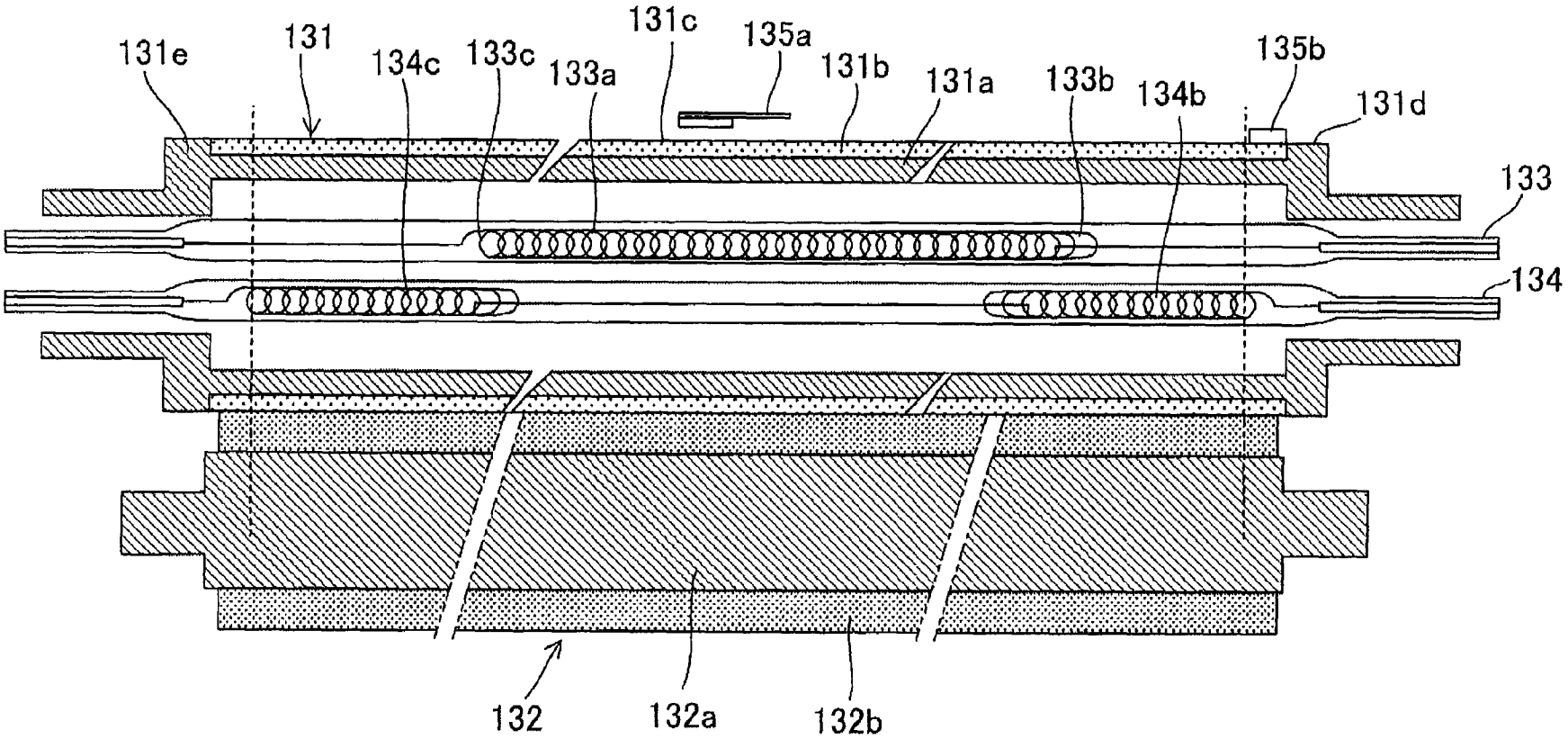
FIG.2 PRIOR ART
FIG. 2 is a schematic sectional view showing the structure of the heat roller and pressing roller.
Figure 3:
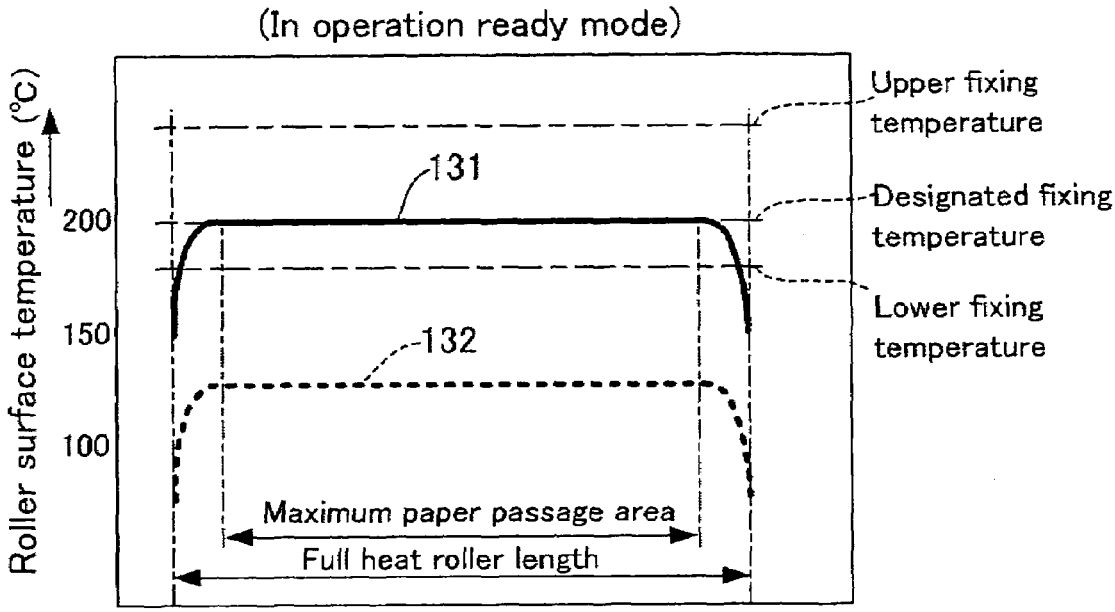
FIG.3 PRIOR ART
FIG. 3 is an illustrative view showing the temperature distributions on the surfaces of the heat roller and pressing roller in the image forming apparatus in operation ready mode.
Figure 4:
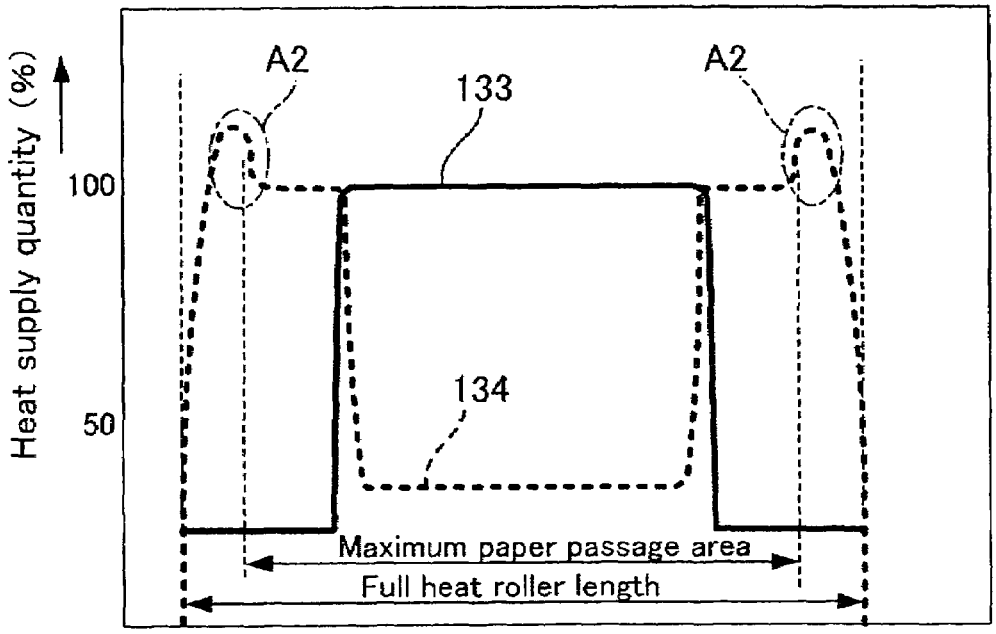
FIG.4 PRIOR ART
FIG. 4 is an illustrative view showing the heat supply distributions of heaters in the heat roller.
Figure 5:
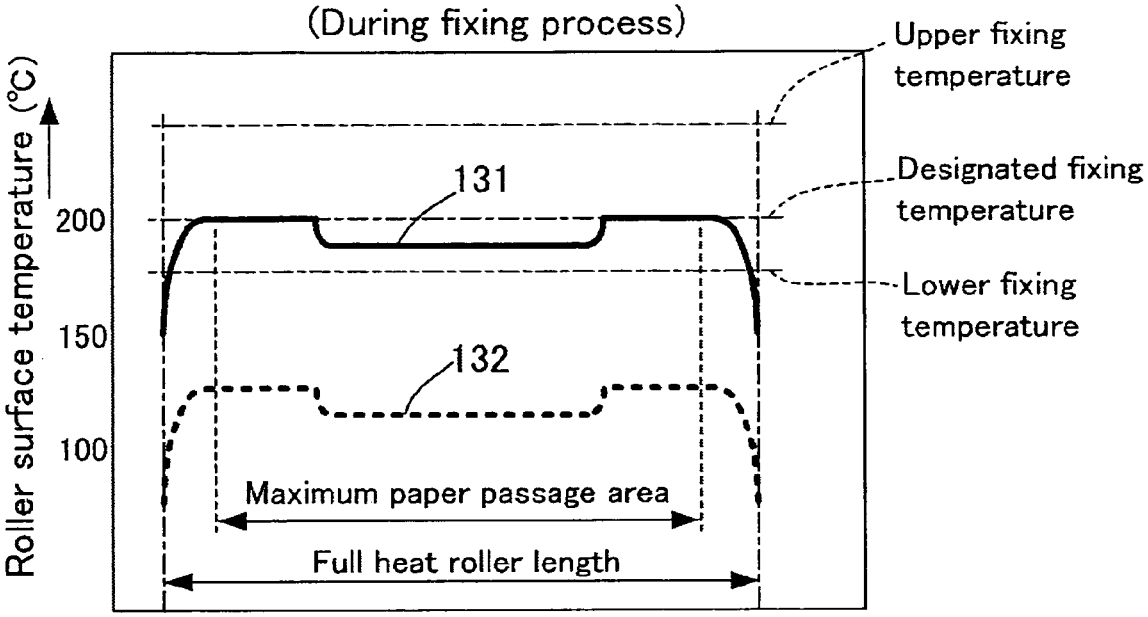
FIG.5 PRIOR ART
FIG. 5 is an illustrative view showing the temperature distributions on the surfaces of the heat roller and the pressing roller when small-sized paper is fixed by the fixing unit.
Figure 6:
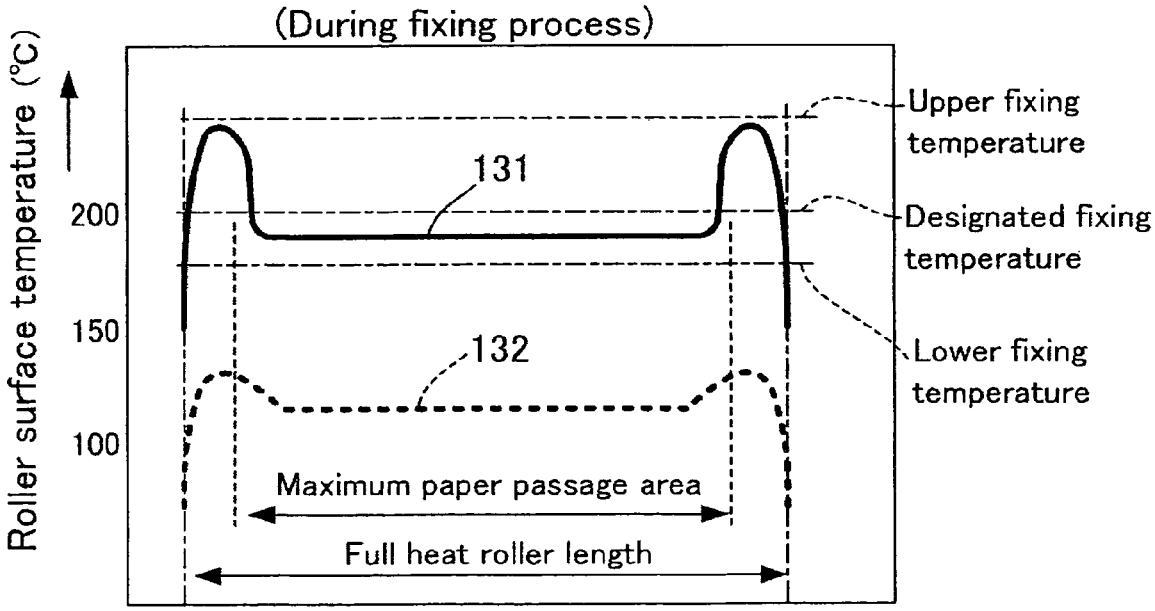
FIG.6 PRIOR ART
FIG. 6 is an illustrative view showing the temperature distributions on the surfaces of the heat roller and the pressing roller when large-sized paper is fixed by the fixing unit.
Figure 7:
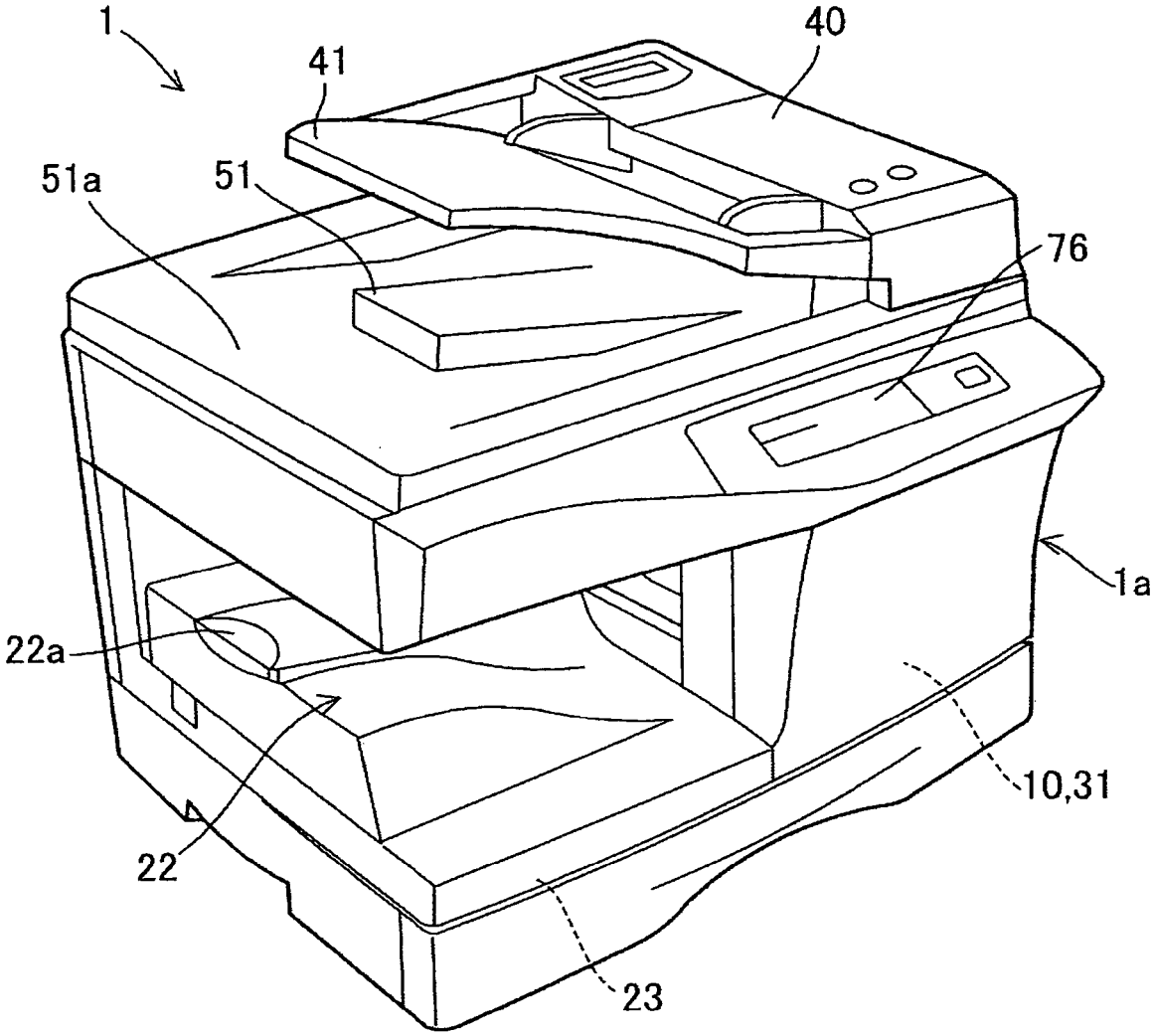
FIG. 7 is a perspective view showing an overall configuration of an image forming apparatus according to the embodiment of the present invention.
Figure 8:
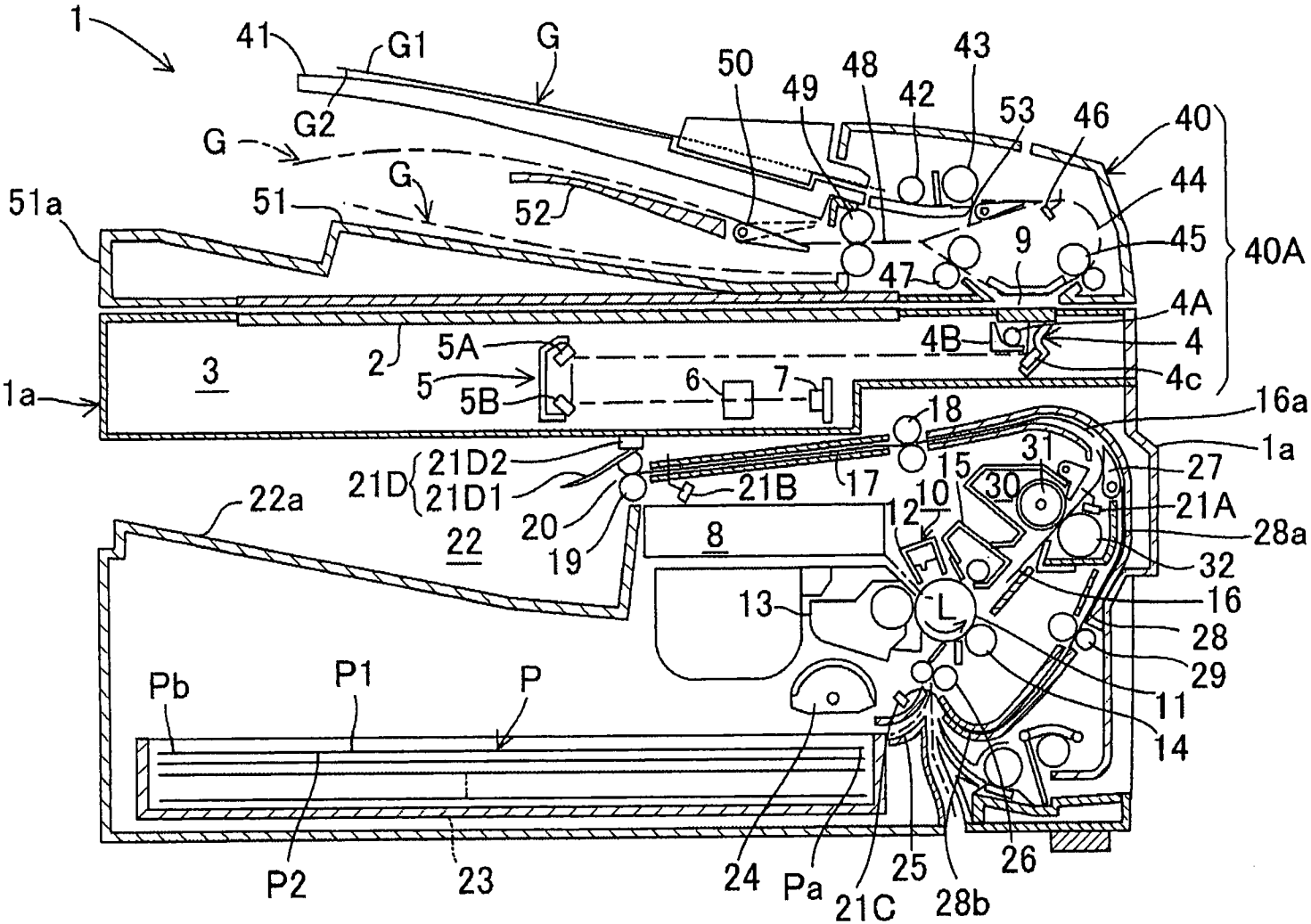
FIG. 8 is a sectional side view showing an internal configuration of the image forming apparatus.

FIGS. 7 and 8 show one example of the embodiment of the present invention, FIG. 7 is a perspective view showing the overall configuration of an image forming apparatus according to one embodiment of the present invention, and FIG. 8 is a sectional side view showing the internal configuration of the image forming apparatus.

An image forming apparatus 1 according to the present embodiment includes a document reader 40A (FIG. 8) for reading image information from an original G, and electrophotographically visualizes the image information of original G, captured by the document reader 40A, with a toner as a toner image on a predetermined sheet of recording paper (to be referred to hereinbelow as the paper) P as a recording medium. The toner image is fused and fixed on paper P by a fixing unit 30, then output.

To begin with, the overall configuration of image forming apparatus 1 according to the present embodiment will be described with reference to the drawings.

As shown in FIGS. 7 and 8, image forming apparatus 1 is provided with an original placement table 2 made of transparent glass on which original G is placed, on the top of an apparatus body 1*a*.

There is an automatic document processor 40 on the top of the original placement table 2 while a scanner portion 3 (FIG. 8) as an image reader for reading image information from original G is laid out under the original placement table 2.

The original placement table 2, scanner portion 3 and automatic document processor 40 and other components constitute the document reader 40A.

Arranged under scanner portion 3 are an image forming portion 10, the fixing unit (fixing portion) 30 and a paper output portion 22. Provided further below is a paper feed cassette 23 which stores the paper P as recording media.

As shown in FIG. 8, scanner portion 3 is composed of an original image reading unit that includes a first scanner unit 4 and a second scanner unit 5, which are arranged under original placement table 2 and move reciprocatively in parallel therewith, an optical lens element 6 and a photoelectric transducer (CCD) 7.

In FIG. 8, the light path in scanner portion 3 is indicated by the chain line.

First scanner unit 4 includes: an exposure lamp 4A; a reflector 4B for illuminating the original image surface with light from the exposure lamp 4A; and a first mirror 4*c* for leading the light image reflected off the original that is exposed by light from the reflector 4B in a predetermined direction, and is controlled so as to move back and forth at a predetermined scan speed, keeping itself parallel to and a predetermined distance from, the underside of original placement table 2.

Second scanner unit 5 includes a second mirror 5A and a third mirror 5B for further directing the light image from the original by way of first mirror 4*c* of first scanner unit 4 in a predetermined direction and is controlled so as to move back and forth parallel to the first scanner unit 4 and at a speed related to the speed of the first scanner unit 4.

Optical lens element 6 is disposed on the optical path of the light that is reflected off the original image and deflected by third mirror 5B of second scanner unit 5 so that the light image is focused on photoelectric transducer 7.

Figure 11:
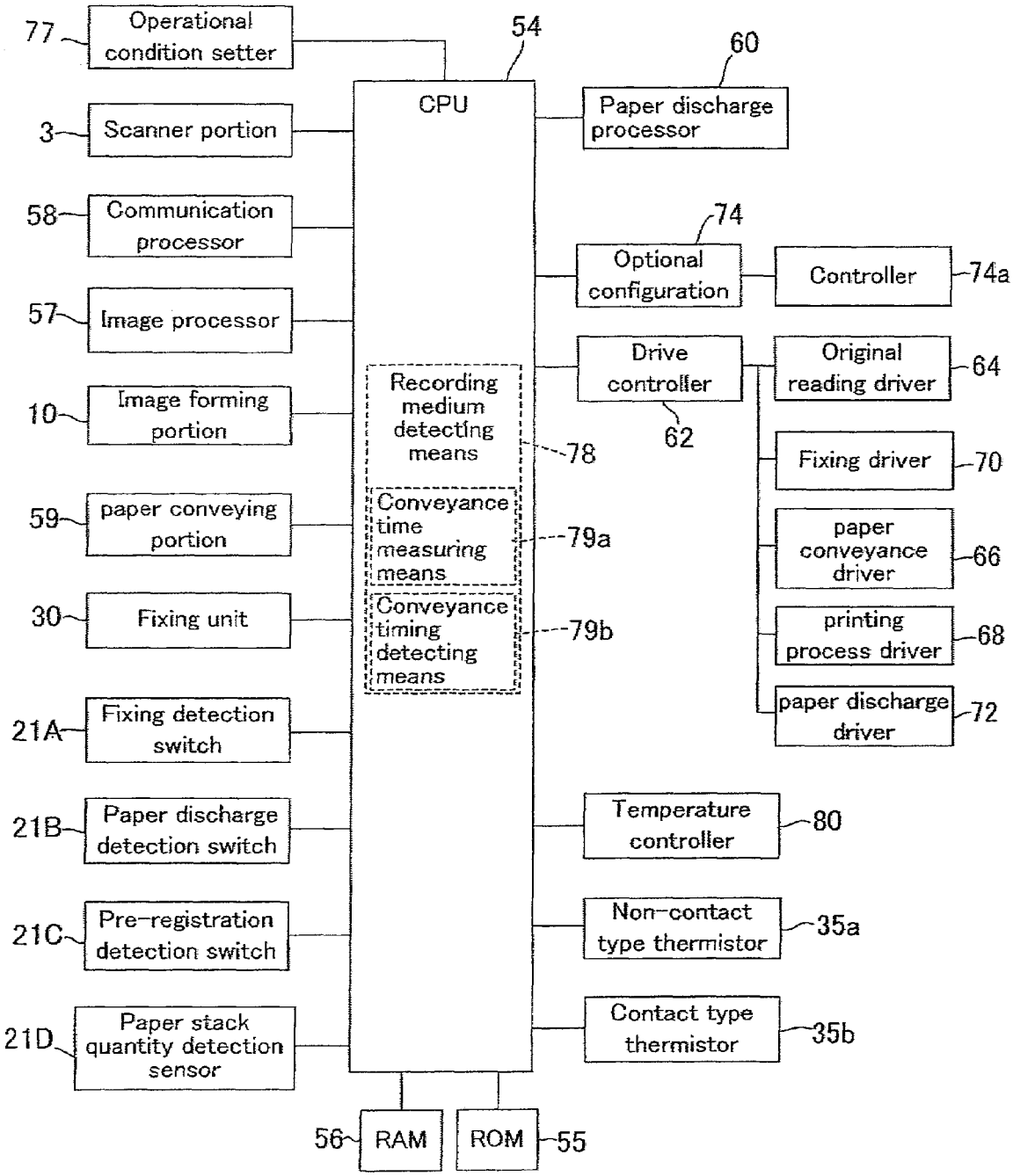
FIG. 11 is a block diagram showing an electric controller configuration of the image forming apparatus.

The photoelectric transducer (e.g., CCD (charge coupled device)) 7 reads the light image of the original image that is focused by optical lens element 6 and photoelectrically converts it into electric signals to thereby create original image information (original image data) and outputs the original image information to an aftermentioned image processor 57 (FIG. 11).

Image processor 57 subjects the original image information output from photoelectric transducer 7 to image processes and produces printing image information (printing image data) so that the resolution, density, and the like will be suited for printing. The print image information after the image processes is transferred to an image data input portion of a laser scanning unit (LSU) 8.

Laser scanning unit 8 emits laser beams in accordance with the printing image information output from image processor 57 to illuminate the surface of a photoreceptor drum 11 as a constituent of image forming portion (image forming process) 10. Thereby, an electrostatic latent image of the printing image information is written on photoreceptor drum 11.

As shown in FIG. 8, image forming portion 10 is mainly comprised of photoreceptor drum 11 driven to rotate in the direction of an arrow L, a main charger 12 for electrifying the photoreceptor drum 11 surface at a predetermined potential, laser scanning unit 8 for illuminating the photoreceptor drum 11 surface with laser beams for forming an electrostatic latent image, a developing unit 13 for visualizing the electrostatic latent image formed by irradiation of the laser beams from the laser scanning unit 8, with toner, a transfer roller 14 for transferring the toner image of the original image visualized by the developing unit 13 to the paper (corresponding to "recording medium": also called "print paper") P that is fed from an aftermentioned paper feed cassette 23 through a paper feed path 25, and a cleaning unit 15 for cleaning the leftover toner remaining on the photoreceptor drum 11 after transfer by the transfer roller 14, all these elements being arranged in the order mentioned along the photoreceptor drum 11 in its rotational direction.

Main charger 12 of image forming portion 10 also has the function of an unillustrated charge erasing device for erasing electricity on the photoreceptor drum 11 surface after cleaning by cleaning unit 15.

Fixing unit 30 has a heat roller 31 and a pressing roller 32 as shown in FIG. 8, and fuses the toner image transferred on paper P and fixes the toner image to paper P as the paper P is passed through and between heat roller 31 and pressing roller 32 by rotating heat roller 31 while the paper P being nipped between the heat roller 31 and pressing roller 32.

Now, fixing unit 30 will be described with reference to the drawings.

Figure 9:
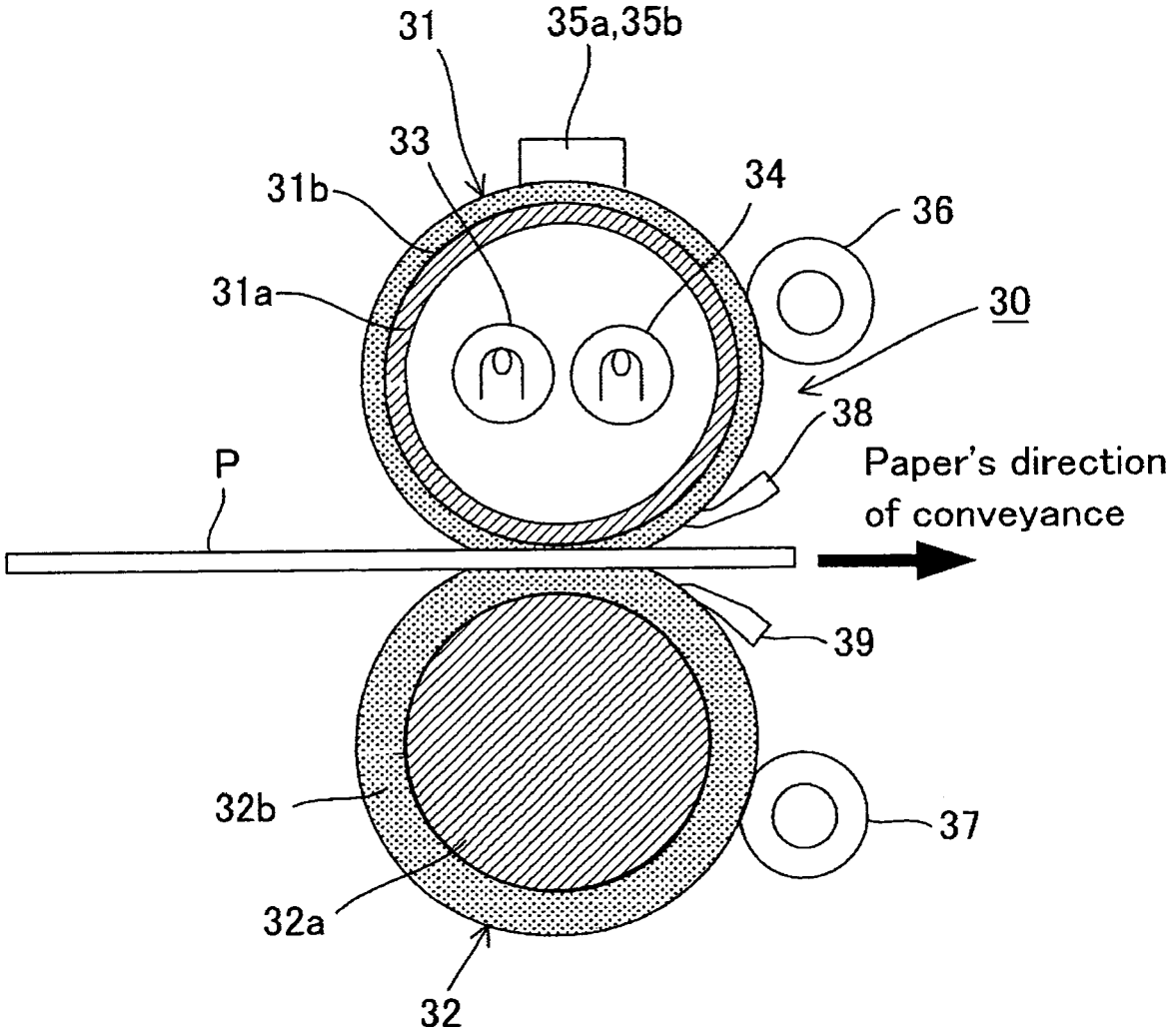
FIG. 9 is a schematic side view showing a heat roller and a pressing roller that constitutes the fixing unit mounted in the image forming apparatus.
Figure 10:
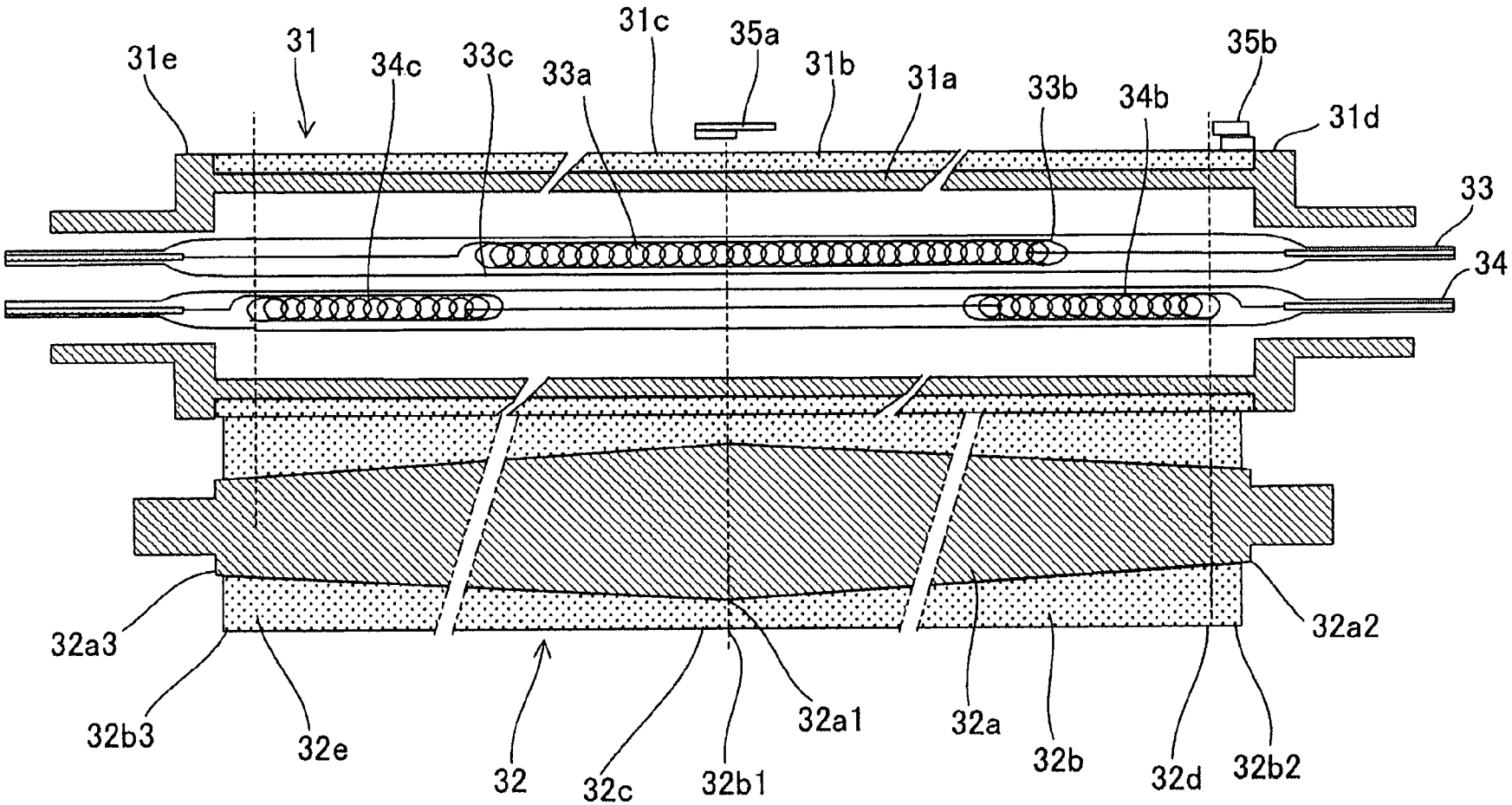
FIG. 10 is a schematic sectional view showing the structure of the heat roller and pressing roller.

FIG. 9 is a schematic side view showing the heat roller 31 and the pressing roller 32 that constitutes the fixing unit 30 mounted in the image forming apparatus 1 according to the present embodiment, and FIG. 10 is a schematic sectional view showing the structure of the heat roller 31 and pressing roller 32.

Fixing unit 30 mounted in the image forming apparatus 1 includes the heat roller 31 and the pressing roller 32, as shown in FIGS. 9 and 10, and is adapted to fuse and fix a toner image that has been transferred on paper P in image forming portion 10, by rotating heat roller 31 with the paper P held between heat roller 31 and pressing roller 32 so as to allow the paper P to pass between heat roller 31 and pressing roller 32.

Heat roller 31 and pressing roller 32 are arranged so as to hold paper P therebetween with a predetermined pressure when paper P passes through the nip.

Arranged on the outer periphery of heat roller 31 are a non-contact type thermistor 35*a* for detecting the surface temperature around the center, designated at 31*c*, of the outer peripheral surface and a contact type thermistor 35*b* for detecting the surface temperature near the roller end.

Arranged on both the peripheral surfaces of heat roller 31 and pressing roller 32 on their upstream side with respect to the paper's direction of conveyance are cleaning rollers 36 and 37 which touch the respective roller's peripheral surfaces to clean the surfaces, as well as blades 38 and 39 for separating the paper P sticking to the roller surfaces.

Heat roller 31 is composed of a hollow cylindrical metal core 31*a* and an elastic part 31*b* of a material having heat resistance such as silicone rubber which covers the outer peripheral side of metal core 31*a* with a predetermined thickness. A main heater 33 and a sub-heater 34 are arranged in the interior space of metal core 31*a* in the extended direction of heat roller 31's axis (there will be some cases in which this direction is referred to as "axial direction", hereinbelow).

As shown in FIG. 10, main heater 33 has a heater element 33*a* around the center 31*c*, in the axial direction of heat roller 31 so as to heat the center 31*c* and thereabout of heat roller 31 as a whole.

On the other hand, sub heater 34 includes a pair of heater elements 34*b* and 34*c* extended from respective ends 33*b* and 33*c* of heater element 33*a* of main heater 33 to both ends 31*d* and 31*e* along the axial direction of heat roller 31 so as to heat both ends 31*d* and 31*e* of heat roller 31.

Main heater 33 is mainly used to fix small-sized paper, and sub heater 34 is used in combination with main heater 33 to fix large-sized paper.

The thus constructed main heater 33 and sub heater 34 are controlled by an aftermentioned temperature controller 80 (FIG. 11) so as to keep the surface temperature of heat roller 31 at the predetermined temperature in conformity with the paper size when a fixing process to the paper P is effected.

Pressing roller 32 (FIG. 10) is composed of a solid cylindrical metal core 32*a* and an elastic part 32*b* of a material having heat resistance such as silicone rubber which covers the outer peripheral side of metal core 32*a*, forming a cylindrical structure having an essentially uniform outside diameter. The pressing roller 32 is arranged in parallel along the axial direction of, and abutted against, heat roller 31.

Further, pressing roller 32 is constructed such that, with respect to the direction perpendicular to the conveying direction of paper P, or the direction along the axis of pressing roller 32, the heat capacity around the center portion, designated at 32*c* of pressing roller 32, is smaller than that around both ends 32*d* and 32*e* of pressing roller 32.

Specifically, as shown in FIG. 10, metal core 32*a* has an approximately cylindrical external shape and is constructed such that the outside diameter of metal core 32*a* along the axial direction is greater at the center, designated at 32*a*1, which opposes the center portion of paper P across the paper width, than the outside diameter at both ends 32*a*2 and 32*a*3 that oppose the side edges of paper P.

On the other hand, elastic part 32*b* that covers metal core 32*a* is formed such that the covering thickness at its center portion, designated at 32*b*1, with respect to the axial direction of metal core 32*a*, which opposes the center portion of paper P across the paper width, is thinner than the covering thickness at both ends 32*b*2 and 32*b*3 that oppose the side edges of paper P.

That is, in order make the surface temperature of heat roller 31 during a continuous fixing process by fixing unit 30 approximately uniform along the axial direction, the elastic part 32*b* is formed so that the covering thickness varies along the axial direction of pressing roller 32 in conformity with the designated surface temperature of heat roller 31, or specifically, the thickness of the elastic part become gradually thicker from center 32*b*1 toward both ends 32*b*2 and 32*b*3.

Next, the paper conveyance path of the image forming apparatus will be described.

As shown in FIG. 8, the paper conveyance path in image forming apparatus 1 is mainly comprised of paper feed path 25 for feeding paper P upwards from paper feed cassette 23 arranged at the bottom of the machine to image forming portion 10, a main conveyance path 16 for conveying paper P from image forming portion 10 to a paper discharge drive roller 18 by way of fixing unit 30; a paper discharge path 17 for conveying paper P from paper discharge drive roller 18 to a paper discharge roller 19; and a sub conveyance path 28 for inverting paper P by driving paper discharge roller 19 in reverse to switch back the paper P using an inversion roller 29.

Paper feed path 25 is extended approximately linearly but gently curved, from a separation roller (not shown) which separates the paper, sheet by sheet if double sheets of paper are fed and is located on the downstream side of a paper pickup roller 24 with respect to the paper's direction of conveyance, to a registration roller 26 arranged in the vicinity of the lower side (the upstream side with respect to the paper's direction of conveyance) of photoreceptor drum 11 of image forming portion 10.

Main conveyance path 16 is formed approximately linearly from the downstream side of registration roller 26 to fixing unit 30 by way of image forming portion 10, and is followed by a curved part that extends approximately upward from the exit side (the downstream side with respect to the paper's direction of conveyance) of fixing unit 30 toward paper discharge drive roller 18 (to the left in the drawing).

Paper discharge path 17 is extended approximately linearly between paper discharge drive roller 18 and paper discharge roller 19.

In order to invert paper P by driving paper discharge roller 19 in reverse to switch back the paper, sub conveyance path 28 is connected to the upper part of main conveyance path 16 (the upstream side with respect to the paper's direction of conveyance) so that paper P can be guided by paper path switching gate 27 and conveyed by inversion roller 29 downwards to the bottom of the apparatus 1 and delivered once again to registration roller 26.

Specifically, sub conveyance path 28 is curved from the machine's top side to the bottom side in order to deflect the direction of movement of paper P that is conveyed in reverse from paper discharge path 17 towards the machine's bottom side and further extended from the machine's bottom side towards the registration roller 26 side.

The paper P with a toner image transferred thereon as it is being nipped between photoreceptor drum 11 and transfer roller 14 is separated from photoreceptor drum 11 and conveyed along main conveyance path 16 that connects the photoreceptor drum 11 and fixing unit 30 into and between heat roller 31 and pressing roller 32 of the fixing unit 30. Heat roller 31 and pressing roller 32 abut each other with a predetermined pressing force, forming a nip portion at that contact.

In fixing unit 30, the paper P held between heat roller 31 and pressing roller 32, i.e., at the nip portion, is heated by heat roller 31 and pressed by pressing roller 32, so that the unfixed toner image that has been transferred from the photoreceptor drum 11 is fixed to the paper P.

The paper P after the fixing by fixing unit 30 is conveyed to paper discharge path 17 and further conveyed by paper discharge drive roller 18 toward paper discharge roller 19 on a paper discharge port 20 side.

The passage status of paper P being conveyed into paper discharge path 17 is detected by a fixing detection switch 21A arranged downstream of fixing unit 30 when the paper P passes by the nip between heat roller 31 and pressing roller 32.

For a case of usual one-sided printing, the paper P is directly conveyed by the rotational drives of paper discharge drive roller 18 and paper discharge roller 19 and discharged through paper discharge port 20 onto a paper output tray 22*a* which is disposed in a space under scanner portion 3. This passage status of paper P through paper discharge roller 19 is adapted to be detected by a paper discharge detecting switch 21B arranged upstream of paper discharge roller 19.

Paper P is discharged sideways of the image forming portion 10 and the discharged paper P is output to paper output portion 22 over cassette 23 and under scanner portion 3.

Paper output portion 22 is mainly comprised of paper discharge path 17, paper discharge drive roller 18, paper discharge roller 19, paper discharge port 20 and paper output tray 22*a*.

Arranged on the outer side of paper discharge port 20 (on the paper output tray 22*a* side) is a paper stack quantity detecting sensor 21D, also called a full stack detecting sensor.

Paper stack quantity detecting sensor 21D is mainly composed of a detecting piece 21D1 which operates when the paper discharged and stacked abuts the detecting piece, and a sensor body 21D2 which outputs a signal in accordance with the operation of detecting piece 21D1.

Detecting piece 21D1 has a rod-shaped configuration with its one end engaged with the sensor body 21D2 side so that the other end side can pivot on the first end, and the piece is arranged obliquely downward and outward from the apparatus side (paper discharge port 20 side).

With this structure, paper stack quantity detecting sensor 21D is adapted to output a detection signal from sensor body 21D2 as the second end of detecting piece 21D1 is pushed upward when the discharged amount of stacked paper has reached a predetermined amount (height).

Arranged at the inner bottom of main apparatus body 1*a* is the exchangeable paper feed cassette 23, in which a stack of paper P of a predetermined paper size is accommodated. A crescent-shaped sheet pickup roller 24 is arranged over the paper delivering side of this paper feed cassette 23.

The paper pickup roller 24 picks up the paper P, sheet by sheet, from the topmost of a stack of paper P in paper feed cassette 23 and conveys the paper P downstream (for convenience, the delivery side of paper P (the cassette side) is referred to as upstream and the direction of conveyance is referred to as downstream) to registration roller (also called "idle roller") 26 in paper feed path 25.

A reference numeral Pa in the drawing designates the front end of paper P and Pb designates the rear end of paper P.

Arranged on the upstream side of registration roller 26 is a pre-registration detection switch 21C. This pre-registration detection switch 21C detects paper P that is fed and conveyed from paper feed cassette 23. Paper feed to the aforementioned image forming portion 10 is adapted to be performed by adjusting the paper feed timing based on this signal.

In the case where duplex printing is performed, after printing by image forming portion 10 has been performed on one side of paper P, the paper P is sent into paper discharge path 17 after passage through fixing unit 30, then once conveyed to the paper discharge roller 19 side. In this condition, paper path switching gate 27 that is disposed near fixing unit 30 is changed over, then paper discharge roller 19 is driven in reverse so that the paper P is switched back and guided into sub conveyance path 28 for reversing the paper. Then, the thus guided paper P is rotationally driven by a sub-drive roller (inversion roller) 29 provided on this sub conveyance path 28 and conveyed to the upstream side of registration roller 26 once again, so that printing on the other side of paper P is performed.

On original placement table 2 of main apparatus body 1*a* the automatic document processor 40 of a document feed type reversing automatic document feeder (R-SPF) integrated with an original presser (original pressing cover) 51*a* is mounted in an openable manner, constituting document reader 40A in combination with scanner portion 3.

Document reader 40A is constructed so as to be able to perform an original reading operation for an individual document in the same control manner as in the conventional apparatus, and provision of automatic document processor 40 makes it possible to perform double-sided reading of original G and also perform automatic sequential reading of a multiple number of originals G.

As shown in FIG. 8, automatic document processor 40 has a document tray 41 on which originals G are set. When a multiple number of originals G are sequentially read, the originals G set on this document tray 41 are picked up, one by one, by a document pickup roller 42 so that original G is guided by a document drive roller 43 through a document conveyance path 44 and conveyed to the upstream side of a registration roller (PS roller) 45.

Provided on the upstream side of this registration roller 45 is a document input sensor 46 for enabling detection of the document size of original G. The document input sensor 46 detects the leading and trailing edges of original G, so that based on the detected signals, the original G can be controlled and conveyed to an original reading station 9 of a glass slit located adjacent to one side of original placement table 2, taking into account the timing of delivery.

In this case, first scanner unit 4 of scanner portion 3 has been controlled and moved so that it is positioned under document reading station 9 for standby.

The original G that is conveyed over this document reading station 9 is scanned so that one side of the original, namely, the first image-scan side G1 is scanned by first scan unit 4 of scanner portion 3 while the original is being moved. Other operations such as image reading by photoelectric transducer 7, image processing of image information, image forming including printing and the like are performed in the same manner as above.

The original G that has been scanned through document reading station 9 is then conveyed by a conveyance roller 47 through a document discharge path 48 toward a document discharge roller 49 side. When document reading is performed for one side only, the document is discharged onto a document output tray 51 by the switching control of a document switching gate 50.

When document reading is performed for both sides, by the switching control of document switching gate 50 original G is once discharged onto a middle tray 52 disposed between document tray 41 and document output tray 51, then is switched back into a document reversing path 53 by driving document discharge roller 49 in reverse. Then the original G is once again fed into document conveyance path 44 so that the original image on the underside of original G, namely the side G2 facing the image reader is scanned while the original image on the underside of original G is printed out on the first printing side P1 of paper P in the same manner as in the above-described one-side printing operation.

When this printing operation for the first printing side P1 of paper P has been finished, paper P is reversed by the above-described sheet reversing device, then fed again into image forming portion 10 so that the original image on the front side of original G that has been previously stored in the memory is printed on the second printing side P2.

As shown in FIG. 7, control switches 76 for allowing the user to set up the image forming conditions such as the sheet type of paper P (sheet thickness and the like in addition to sheet size), print number, magnification, density and the like are arranged on the front portion on the upper side of apparatus body 1*a* of image forming apparatus 1.

Referring next to FIG. 11, the control system of image forming apparatus 1 according to the embodiment will be described.

FIG. 11 is a block diagram showing an electric controller configuration of the image forming apparatus 1 according to the present embodiment.

As shown in FIG. 11, image forming apparatus 1 according to the embodiment performs processes such as image reading, image processing, image forming and conveyance of paper P, and the like by a central processing unit (CPU) 54 which performs control in accordance with a program stored beforehand in ROM (read only memory) 55, using temporal storage such as RAM (random access memory) 56 or the like. It is also possible to use other storage such as a HDD (hard disk drive) or the like instead of ROM 55 and RAM 56.

In image forming apparatus 1, the image information of an original (original image data) captured by scanner portion (original reading portion) 3, or original image information transmitted from other terminal devices connected via an unillustrated communication network, is adapted to be input to image processor 57 by way of a communication processor 58.

Image processor 57 shapes the original image information stored in the storage such as RAM 56 or the like into a printing image that is suitable for printing (image forming onto paper), in accordance with the aforementioned program.

The printing image information is input to image forming portion 10.

Image forming portion 10, paper conveying portion (performing various detections and controls of paper P in paper feed path 25, main conveyance path 16, sub conveyance path 28 (these are also called paper guides)) 59, fixing unit 30 and paper discharge processor (performing various detections and controls of paper P in paper discharge path 17) 60 are linked with respective drive controllers 62.

Paper conveying portion 59 conveys paper P through the printing stage (image information is printed in image forming portion 10) and the fixing stage where the paper P having been processed with printed information is fixed (in fixing unit 30) and then discharges the sheet to paper discharge portion (paper output tray 22*a*).

Here, paper conveying portion 59 receives detection signals from fixing detection switch 21A, paper discharge detection switch 21B, pre-registration detection switch 21C and the like.

Image forming apparatus 1 has an operational condition setter 77. This operational condition setter 77 sets up operational conditions for image forming and conditions of conveyance and the like in image forming apparatus 1, in accordance with the image forming request and the image forming conditions such as the type of recording media designated by the user through control switches 76.

Further, in image forming apparatus 1, based on the set operating conditions, drive controller 62 is adapted to control drive actuators for the aforementioned reading portion (scanner portion 3), paper conveying portion 59, image forming portion 10, fixing unit 30, paper discharge processor 60 and the like namely, an original reading driver 64, a paper conveyance driver 66, a printing process driver 68, a fixing driver 70 and a paper discharge driver 72 so that they can operate in synchronization with instructions from CPU 54 in accordance with the program stored in ROM 55.

Paper discharge processor 60 makes control of a paper discharge process of discharging the printed paper to the paper output tray and performs the paper discharge process based on the signal output from paper stack quantity detecting sensor 21D.

Original reading driver 64 is a drive actuator for the first scanner unit 4 and the second scanner unit 5 of scanner portion 3.

Paper conveyance driver 66 means paper conveying portion 59, specifically, drive motors for paper pickup roller 24 and registration roller 26 along the aforementioned paper feed path 25.

Printing process driver 68 is a drive motor for photoreceptor drum 11.

Fixing driver 70 includes drive motors for heat roller 31 and pressing roller 32 in fixing unit 30.

Paper discharge driver 72 includes drive motors for paper discharge drive roller 18, paper discharge roller 19 and the like.

All these drive motors of the drivers may be configured of common or different motors with appropriate power transmission mechanisms.

Further, image forming apparatus 1 may be used with optional configurations 74 including automatic document processor (automatic document reader) 40. These optional configurations 74 incorporate individual controllers 74*a* separately from the controller of the image forming apparatus 1 so as to operate in synchronization with the main apparatus by performing timing adjustment via the aforementioned communication processor 58.

A recording medium detecting means 78 detects arrival of the leading end of the recording medium at fixing unit 30 or the discharge portion.

Recording medium detecting means 78 is adapted to detect the timings at which the paper P arrives at (enters) fixing unit 30 and paper discharge drive roller 18 based on the conveyance timing of the recording medium detected by an aftermentioned conveyance timing detecting means 79*b*.

Specifically, recording medium detecting means 78 includes: a conveyance time measuring means 79*a* for measuring the time of conveyance of paper P from when the paper is delivered from registration roller 26 at the entrance of paper feed path 25 where the paper is introduced; and a conveyance timing detecting means 79*b* for detecting the timings at which paper P is conveyed in main conveyance path 16 and in paper discharge path 17, based on the paper's speed of conveyance and the distances from registration roller 26 to the components to be controlled, i.e., fixing unit 30 and discharge drive roller 18.

Further, in image forming apparatus 1, the fixing temperature determined by heat roller 31 in fixing unit 30 is adapted to be controlled by temperature controller 80 in accordance with the operating conditions.

Temperature controller 80 performs control so as to keep the designated fixing temperature based on the heat roller 31's surface temperature that is detected by non-contact type thermistor 35*a* and contact type thermistor 35*b* provided for heat roller 31.

Next, temperature control of heat roller 31 will be described with reference to the drawings.

Figure 12:
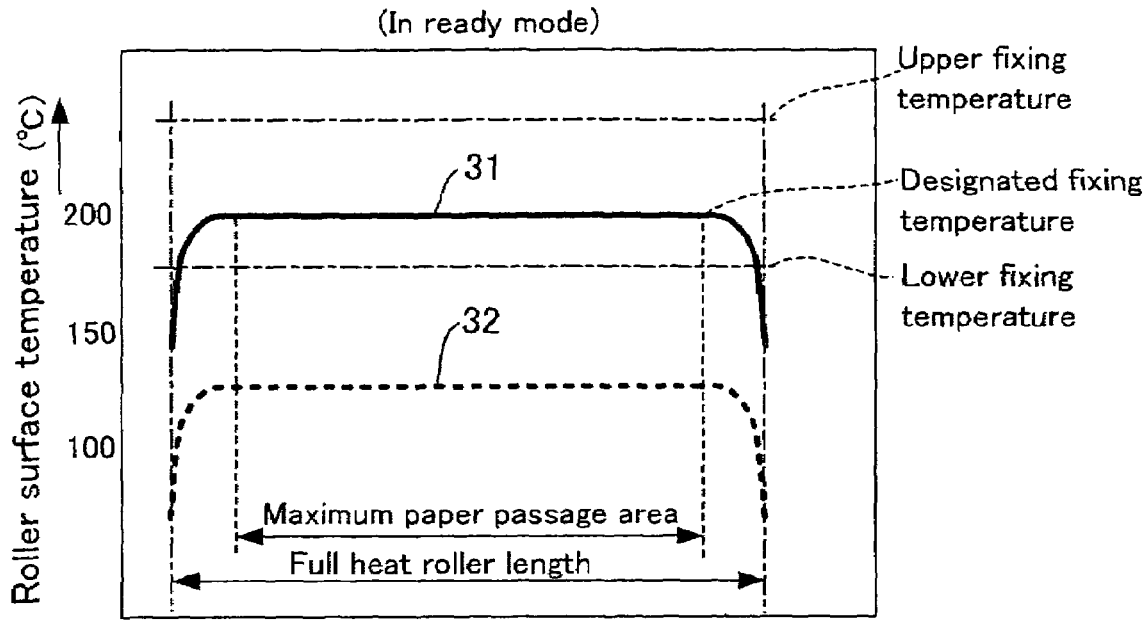
FIG. 12 is an illustrative view showing the temperature distributions on the surfaces of the heat roller and pressing roller of the fixing unit in operation ready mode.
Figure 13:
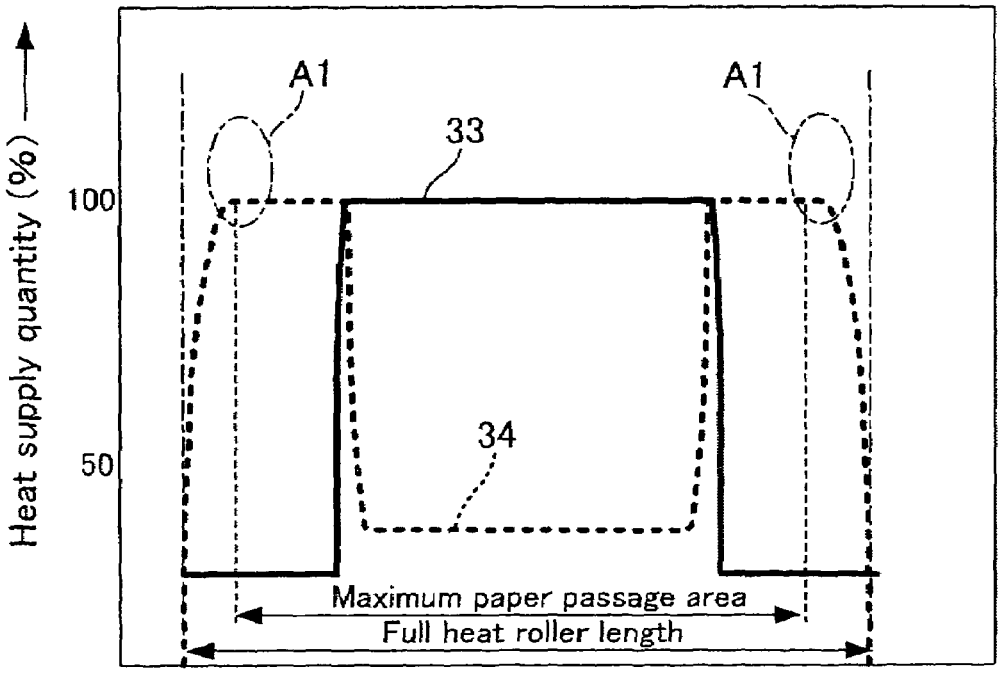
FIG. 13 is an illustrative view showing the heat supply distributions of the heaters in the heat roller.
Figure 14:
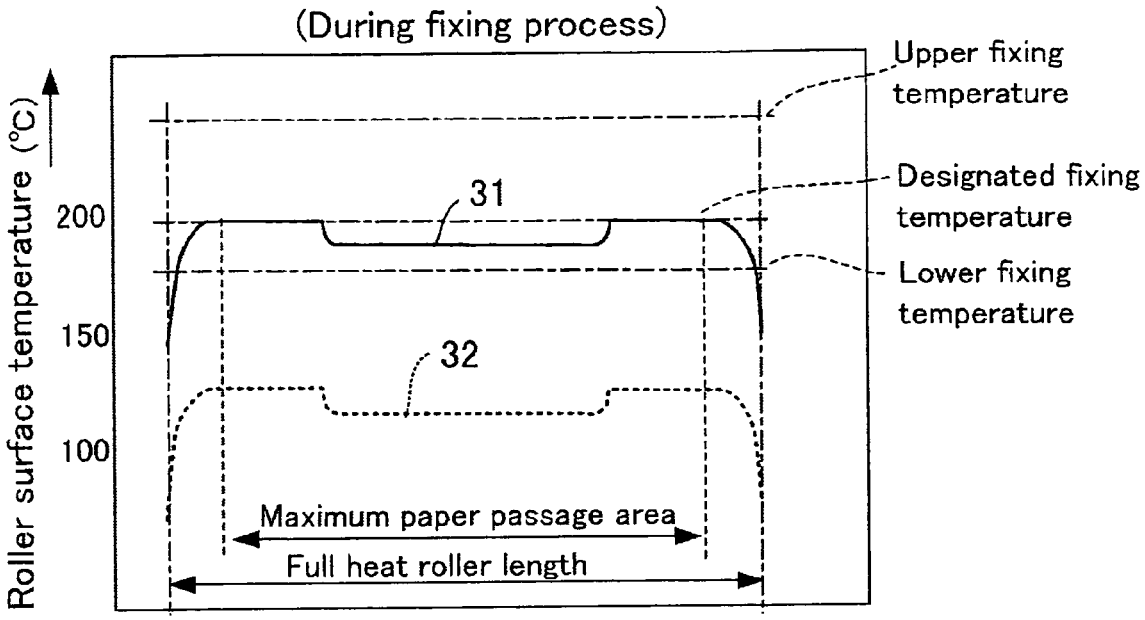
FIG. 14 is an illustrative view showing the temperature distributions on the surfaces of the heat roller and the pressing roller when small-sized paper is fixed by the fixing unit.
Figure 15:
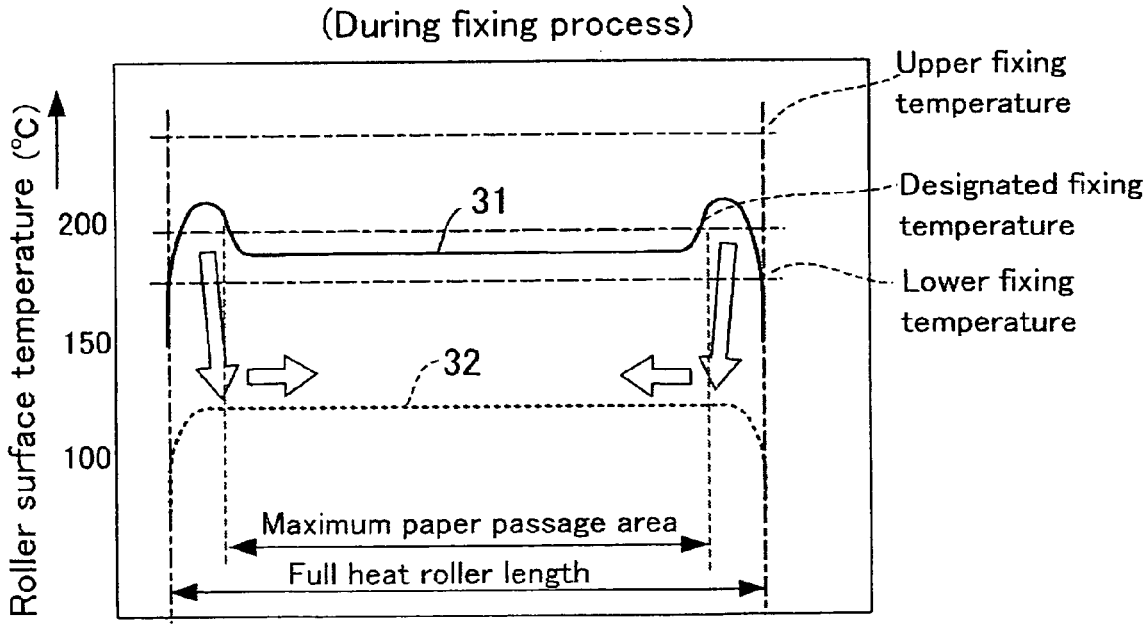
FIG. 15 is an illustrative view showing the temperature distributions on the surfaces of the heat roller and the pressing roller when large-sized paper is fixed by the fixing unit.

FIG. 12 is an illustrative view showing the temperature distributions on the surfaces of the heat roller 31 and pressing roller 32 of the fixing unit 30 in operation ready mode in the image forming apparatus 1 according to the present embodiment; FIG. 13 is an illustrative view showing the heat supply distributions of heaters 33,34 in the heat roller 31; FIG. 14 is an illustrative view showing the temperature distributions on the surfaces of the heat roller 31 and the pressing roller 32 when small-sized paper is fixed by the fixing unit 30; and FIG. 15 is an illustrative view showing the temperature distributions on the surfaces of the heat roller 31 and the pressing roller 32 when large-sized paper is fixed by the fixing unit 30.

When the image forming apparatus 1 is ready for operation, main heater 33 and sub heater 34 are controlled so that the surface temperature of heat roller 31 is maintained at approximately 200 deg. C. (designated fixing temperature) uniformly along the axial direction, as shown in FIG. 12 while the surface temperature of pressing roller 32 is kept at approximately 120 to 130 deg. C. along the axial direction.

The heat supply distributions of main heater 33 and sub heater 34 are arranged so as to provide a uniform heat supply distribution across the heat generating portion as shown in FIG. 13.

In the drawing, the portions A1 enclosed by the broken line are covered so as not to become high in temperature by virtue of heat radiation from both ends of pressing roller 32 and heat reserving effect of elastic part 32*b*.

The operation of the fixing process by the thus constructed fixing unit 30 will be described hereinbelow.

First, when small-sized paper has been fixed, the surface temperatures of heat roller 31 and pressing roller 32 lower in the area where the paper passes as shown in FIG. 14 because heat is taken from the rollers by the passage of paper and by being used for fusing and fixing unfixed toner, but this temperature drop still falls within the range in which fixing is permissible.

When large-sized paper has been fixed, as shown in FIG. 15, the surface temperature of pressing roller 32 lower uniformly across the approximately full length of the roller, including the portion corresponding to the paper to be fixed. However, this temperature drop also falls within the range in which fixing is permissible.

On the other hand, the surface temperature of heat roller 31 lowers in the area corresponding to the paper to be fixed while the surface temperature other than the area of the paper size rises than the designated fixing temperature. However, this temperature rise is inhibited to be much smaller than the temperature rise in the conventional configuration.

This is because elastic part 32*b* covering pressing roller 32 is formed to become gradually thicker from the center portion 32*c* of pressing roller 32 toward both ends 32*d* and 32*e*. That is, the heat storage capacity of elastic part 32*b* can be made greater as it goes toward both ends 32*d* and 32*e*, so that it is possible to decrease the temperature rise at both ends 32*d* and 32*e* due to thermal influence from heat roller 31.

According to the present embodiment thus constructed, pressing roller 32 is constructed by metal core 32*a* and elastic part 32*b* that covers the outer periphery of metal core 32*a* so that the heat capacities at both ends 32*d* and 32*e* will be greater than that in the center portion 32*c*. Accordingly, the temperature rise at both ends of heat roller 31 and pressing roller 32 can be regulated without the necessity of complicated temperature control, thus making it possible to enhance the lives of heat roller 31 and pressing roller 32.

Also, the above construction of pressing roller 32 makes it possible to simplify the heat supply characteristics of the heat generator, i.e., heaters of heat roller 31.

Though, in the present embodiment, two heaters are used as the heat source for heat roller 31, the specification of the heat source is not particularly limited in the present invention, but other heating elements may be used. Further, the elastic part that covers the pressing roller can be formed as appropriate depending on the heat source configuration.

What is claimed is:

1. An image forming apparatus comprising:

a recording medium conveying portion for conveying a recording medium;

an image forming portion for forming a visible developer image on the recording medium being conveyed, with a developer in accordance with input image information; and, a fixing portion for fusing and fixing the visible developer image formed on the recording medium to the recording medium by using a heat roller and a pressing roller, the heat roller having an internal heater extending across a full width of the heat roller, wherein, the pressing roller is composed of a metal core that forms a core shaft of the pressing roller and an elastic part that covers an outer periphery of the metal core, and is constructed so that a heat capacity at a center portion of the pressing roller with respect to a direction perpendicular to the recording medium's direction of conveyance is smaller than heat capacities at both ends of the pressing roller, wherein as the heat roller is heated in its full width by the internally provided heater the temperature at outermost edges of a recording medium passage area of the heat roller becomes higher as compared to a temperature at a central portion thereof due to a recording medium having a width less than the width of the recording medium passage area being conveyed between the heat roller and the pressing roller, wherein the ends of the pressing roller extend at least to outermost edges of a recording medium passage area such that a heat capacity of the pressing roller at an outermost edge of the end is a maximum as the recording medium is being conveyed.

2. An image forming apparatus according to claim 1, wherein the elastic part is formed so that a covering thickness at a position which opposes a center of a recording medium with respect to the direction perpendicular to the recording medium's direction of conveyance is thinner than a covering thickness at positions that oppose side edges of the recording medium.

3. An image forming apparatus according to claim 2, wherein the metal core has an approximately cylindrical external shape and is constructed such that an outside diameter of the metal core at a position opposing the center of the recording medium with respect to the direction perpendicular to the recording medium's direction of conveyance is greater than an outside diameter at the positions that opposes the side edges of the recording medium.

4. An image forming apparatus according to claim 3, wherein the elastic part is formed so that the covering thickness varies along an axial direction of the pressing roller in conformity with a designated surface temperature of the heat roller, so as to make a surface temperature of the heat roller during a continuous fixing process by the fixing portion approximately uniform along the axial direction.

5. An image forming apparatus according to claim 2, wherein the elastic part is formed so that the covering thickness varies along an axial direction of the pressing roller in conformity with a designated surface temperature of the heat roller, so as to make a surface temperature of the heat roller during a continuous fixing process by the fixing portion approximately uniform along the axial direction.

6. An image forming apparatus according to claim 1, wherein the metal core has an approximately cylindrical external shape and is constructed such that an outside diameter of the metal core at a position opposing a center of a recording medium with respect to the direction perpendicular to a recording medium's direction of conveyance is greater than an outside diameter at positions that opposes side edges of the recording medium.

7. An image forming apparatus according to claim 6, wherein the elastic part is formed so that a covering thickness varies along an axial direction of the pressing roller in conformity with a designated surface temperature of the heat roller, so as to make a surface temperature of the heat roller during a continuous fixing process by the fixing portion approximately uniform along the axial direction.

8. An image forming apparatus according to claim 1, wherein the heat capacity of the pressing roller continually increases from the center portion to the ends of the pressing roller.

* * * * *